United States Patent [19]

Prisco

[11] Patent Number: 5,010,600

[45] Date of Patent: Apr. 30, 1991

[54] TOILET ODOR REMOVAL SYSTEM

[76] Inventor: Anthony Prisco, 3600 Redwood St., Las Vegas, Nev. 89103

[21] Appl. No.: 481,344

[22] Filed: Feb. 16, 1990

[51] Int. Cl.[5] ..... E03D 9/05

[52] U.S. Cl. ..... 4/217; 4/211; 4/213

[58] Field of Search ..... 4/213, 216, 209, 217, 4/218, 211, 347, 352

[56] References Cited

U.S. PATENT DOCUMENTS

| | | | |
|---|---|---|---|
| 3,192,539 | 7/1965 | Martz | 4/213 X |
| 3,359,884 | 6/1966 | Statter | 98/43 |
| 3,600,724 | 8/1968 | Stamper | 4/217 |
| 3,896,509 | 7/1975 | Stipp et al. | 4/209 |
| 4,007,498 | 2/1977 | Pearson | 4/213 |
| 4,125,906 | 11/1978 | Weiland | 9/52 |
| 4,165,544 | 8/1979 | Barry | 4/213 |
| 4,175,293 | 11/1979 | Stephens et al. | 4/217 X |
| 4,232,406 | 11/1980 | Beeghly et al. | 4/213 |
| 4,251,888 | 2/1981 | Turner | 4/217 X |
| 4,402,091 | 9/1983 | Ellis et al. | 4/217 |
| 4,556,999 | 12/1985 | Lindley | 4/217 |
| 4,882,790 | 11/1989 | Ricard | 4/213 |

*Primary Examiner*—Charles E. Phillips

[57] ABSTRACT

A system for exhausting noxious vapors from a bathroom and exhausting the same through a ceiling or wall mounted exhaust fan. The system can utilize an existing exhaust fan in the ceiling or wall of the bathroom as found in older buildings or an exhaust fan in a modified version for installation in a new structure. The system is operable to draw noxious vapors primarily from the toilet seat having an integral exhaust conduit connected to a duct coupled to the housing of the exhaust fan. Provision is made for an exhaust intake for drawing noxious vapors into the exhaust fan housing from a secondary source such as directly from the bathroom. The noxious fumes are vented from the exhaust fan housing to the atmosphere.

2 Claims, 3 Drawing Sheets

TOILET ODOR REMOVAL SYSTEM

BACKGROUND OF THE INVENTION

This invention relates to a system for exhausting noxious vapors from a toilet or the bathroom in which the toilet is housed or both.

Modern building codes require that rooms housing toilets be provided with an exhaust system vented to the atmosphere. This is especially so when the room is a small one not having any opening in the exterior wall, such as a window that can be opened to allow fresh air to enter the room. It has been long recognized that the strongest source of noxious odors occurs at the toilet seat when the same is occupied by a person.

In the past a number of systems have been proposed for the elimination or reduction of the noxious vapors emanating from the toilet and the room in which the toilet is housed. Many of the systems involve modifications to the toilet seat to accommodate odor evacuation devices. Examples of such modified seats are disclosed in U.S. Pat. No. 4,175,293 to Stephens et al.; Lindley U.S. Pat. No. 4,556,999; and Stamper et al., U.S. Pat. No. 3,600,724.

In order for an odor evacuation device to function, a bathroom must have a source of suction or vacuum. Most building codes require an exhaust system including an exhaust fan located in the ceiling or wall of the room in which the toilet is housed.

It is an object of the present invention to provide a bathroom exhaust system that will meet building code requirements while at the same time being wholly functional to evacuate noxious vapors at the strongest source, that is, at the toilet seat and also from the room in which the toilet is located.

It is a further object of the invention to provide a bathroom exhaust system readily adaptable to new building construction or the renovation or modification of existing structures.

These and other objects of the invention will be apparent from the following disclosure of preferred embodiments of the invention.

SUMMARY OF THE INVENTION

This invention relates to an exhaust system functional to draw noxious vapors from a plurality of sources. The system comprises an exhaust fan that is housed in an exhaust fan housing that is vented to the atmosphere. The exhaust fan housing is connected by a duct to a first source of noxious vapors as, for example, a toilet seat. The exhaust fan housing also may have a noxious vapor intake opening therein directly from the bathroom in which the toilet is housed. The exhaust fan housed within the exhaust fan housing is operable to create a suction effect in the exhaust fan housing effective to draw noxious vapors through the duct from the toilet bowl and the bathroom for exhaust to the atmosphere.

BRIEF DESCRIPTION OF THE DRAWINGS

This invention is best understood with reference to the drawings, in which.

DETAILED DESCRIPTION OF THE INVENTION

Figure 1:
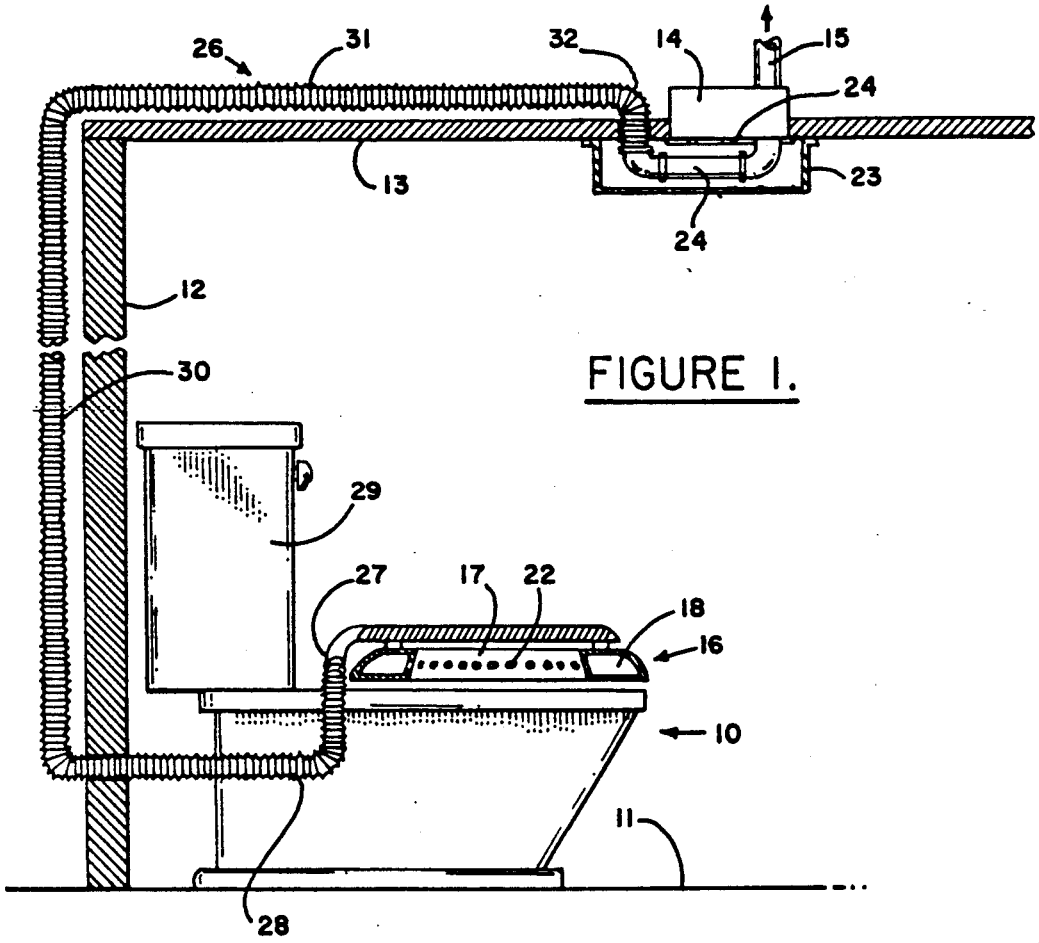
FIG. 1 is a side elevational view, in part sectional, of a bathroom equipped with a noxious odor evacuation system in accordance with the present invention.

Referring to FIG. 1, there is shown a portion of a typical bathroom having a toilet 10 seated on a floor 11, a rear wall 12 and a ceiling 13. If the bathroom is in an interior or windowless room of the building, most modern building codes require that an exhaust fan (not shown) housed in a fan housing 14, preferably mounted in the ceiling, be provided. The fan housing 14 must be vented to the atmosphere through a vent pipe 15. In a conventional arrangement where the exhaust fan housing communicates by a vent only in the ceiling, the average ceiling mounted exhaust fan is only partially effective in removing noxious vapors generated at the level of the toilet. The ceiling mounted fan is required to move a relatively large volume of air in the bathroom to reduce the concentration of noxious vapor generated at the toilet seat. In effect, the noxious vapors have to be diffused throughout the bathroom before being drawn into the suction of the exhaust fan.

Figure 3:
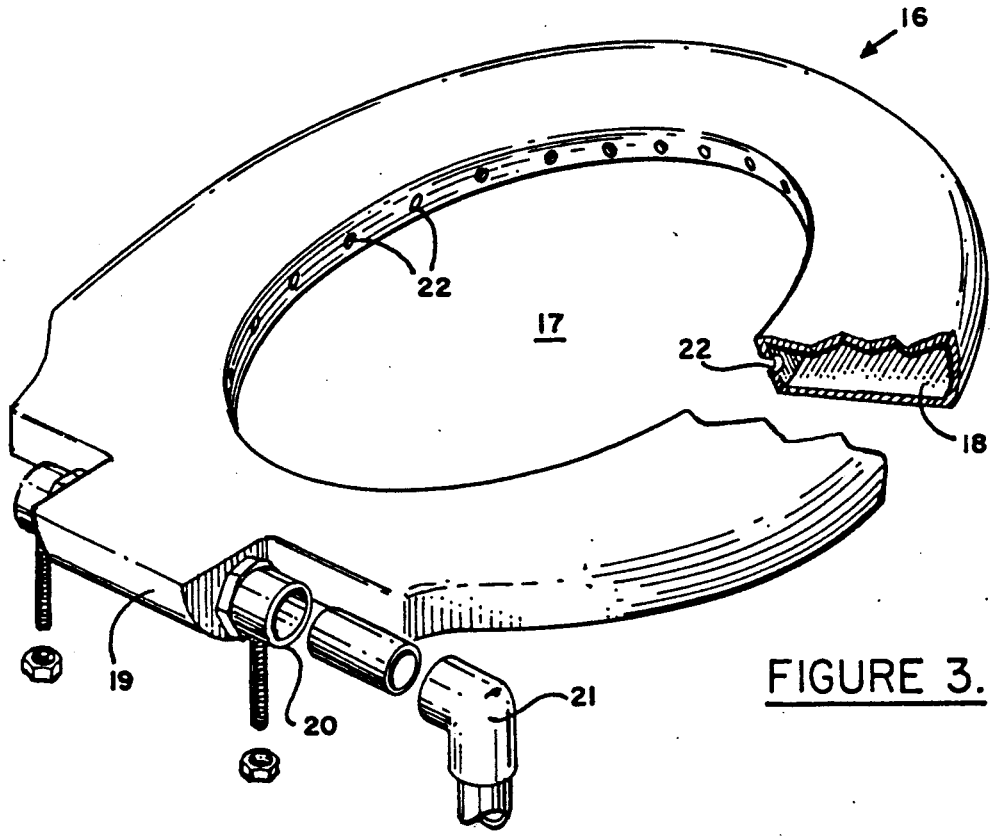
FIG. 3 is an enlarged perspective view of a toilet seat suitable for use in the noxious odor evacuation system in accordance with the present invention.

The present invention provides a kit for the utilization of an existing ceiling mounted exhaust fan in an improved noxious vapor withdrawal system for an existing building. The kit includes a toilet seat, generally designated 16, as a replacement for the typical toilet seat used on conventional toilets. As shown in FIG. 3, toilet seat 16 has a generally annular shape having a central opening 17 and a peripheral conduit 18 extending internally around the seat and terminating at the rear end 19 in an exhaust outlet 20 adapted to receive pipe fittings 21. A plurality of spaced laterally extending apertures 22 extend from the conduit 18 to the central opening 17.

Referring now to FIGS. 1 an 2, a cover assembly including a cover box 23 and a cover plate 24 is provided to replace the grillwork normally associated with the air intake of the ceiling mounted exhaust fan mounted in the exhaust fan housing 14. The cover box 23 conceals the cover plate 24 that attaches to the bottom or open end of an existing fan housing 14 to reduce the area of the large air intake opening of the latter. The cover plate 24 has an aperture or smaller air intake opening 25 at one end.

The exhaust outlet 20 on the seat 16 communicates with the air intake opening 25 in the exhaust fan housing cover plate 24 through an elongated duct 26 that preferably is in the form of a flexible hose. The effective size of the air intake opening 25 is equivalent to the inside diameter of the exhaust duct 26. The end 27 of the duct 26 is connected to the exhaust outlet 20 on the seat 16 through the pipe fittings 21. The duct 26 has a horizontally extending section 28 that passes beneath the toilet water closet 29 through the rear wall 12 of the bathroom. The duct 26 then has a vertical section 30 that extends upwardly to a level above the bathroom ceiling 13. The vertical section 30 is followed by a horizontal section 31 that terminates in a right angle bend section 32 that enters into the cover box 23. The section 32 is coupled to an elbow 33 at one end of a conduit 34 that passes beneath the cover plate 24. At its other end the conduit 34 has upwardly turned elbow 35 where it is coupled to the air intake opening 25.

The particular path described for the duct 26 may vary depending on the wall structure surrounding the bathroom. Preferably, the duct 26 is long enough to reach from the exhaust outlet 21 on the toilet seat 16 to the intake opening 25 and to do so with minimal exposure outside of the rear wall 12 and ceiling 13 of the bathroom.

The cover box 23 is bolted to the cover plate by a suitable fastener such as a bolt 36.

With the foregoing arrangement the ceiling mounted exhaust fan in its housing 14 can be operated to withdraw noxious vapors generated at the level of the toilet seat 16. The noxious vapors will be drawn through the apertures 22 into the conduit 18 in the toilet seat and then through the exhaust outlet 20. From the exhaust outlet 20, the noxious vapors will be drawn through the duct 26 to the exhaust fan housing 14 by way of the air intake opening 25 in the cover plate 24.

Figure 4:
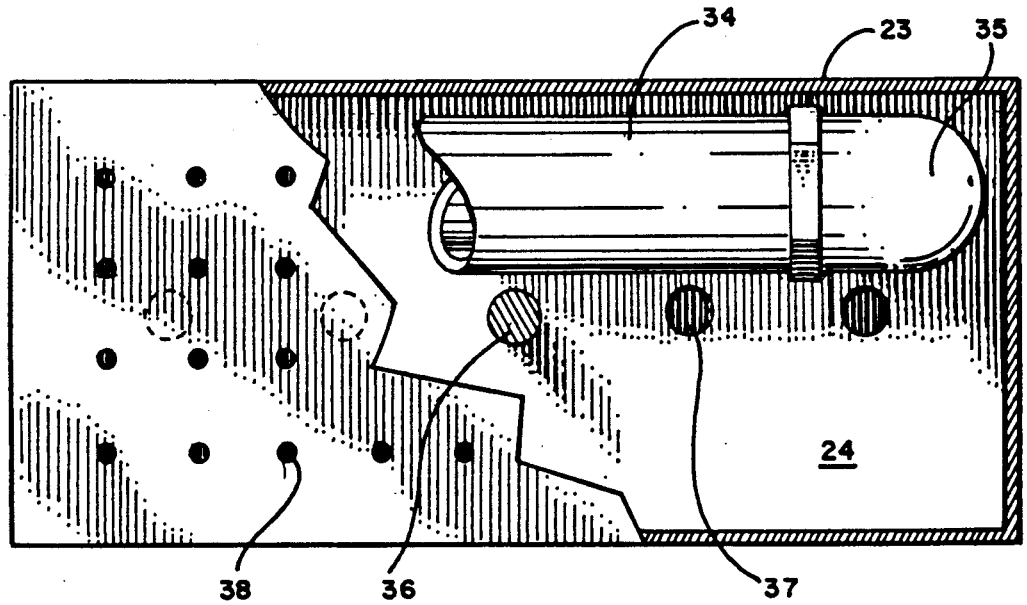
FIG. 4 is a cut-away view taken in the direction of the arrow 4 in FIG. 2.

The cover box 23 may be modified to permit the exhaust fan to draw air into the fan housing 14 from just below the ceiling level of the cover box 23. As seen in FIG. 4, the cover plate 24 may have a pattern of apertures 37 through which the exhaust fan in the exhaust fan housing 14 is able to place suction on the interior of the cover box 23. The cover box 23 is provided on its bottom with a series of apertures 38 through which noxious vapors from the bathroom at large may be exhausted to the atmosphere.

The toilet seat 16, the duct 26, the cover plate 24 and the cover box 23 comprise the basic components of a kit having utility to retrofit a bathroom having a pre-installed ceiling mounted exhaust fan with an improved noxious vapor exhaust system.

Figure 2:
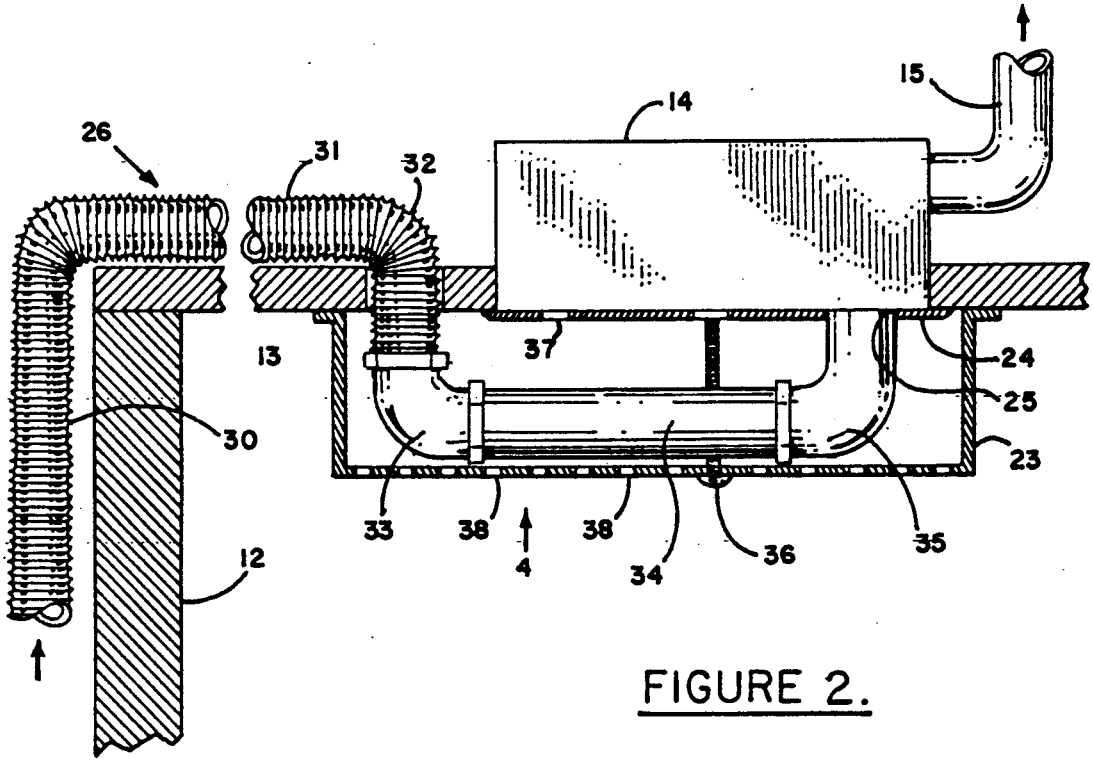
FIG. 2 is an enlarged view in part sectional of the exhaust fan area of the noxious odor evacuation system shown in FIG. 1.
Figure 5:
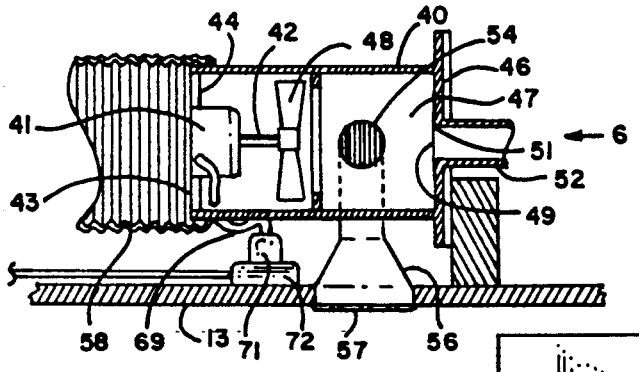
FIG. 5 is a cross sectional view illustrating a second embodiment of an exhaust fan housing.
Figure 6:
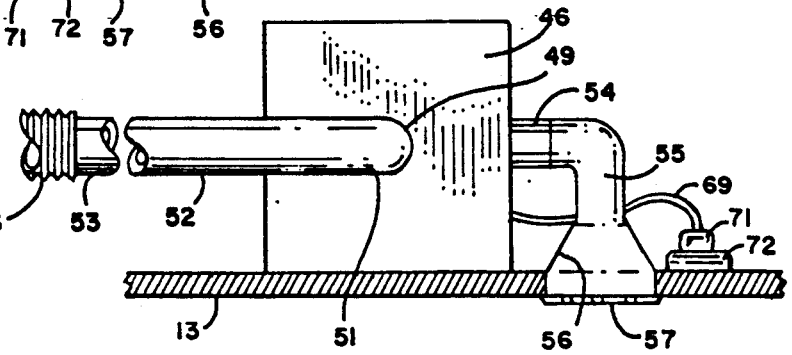
FIG. 6 is a view taken in the direction of the arrow 6 in FIG. 5.

Referring now to FIGS. 5 and 6, an alternate embodiment of the invention is shown in which the configuration of the exhaust fan housing , herein designated 40, differs from the box-like housing 14 shown in FIGS. 1 and 2. The embodiment shown in FIGS. 1 and 2 is primarily intended for application to an existing exhaust fan installation whereas the FIG. 5 embodiment preferably is intended for use in new construction. The exhaust fan housing 40 of FIG. 5 is an elongated cylindrical housing adapted to be mounted above the ceiling 13 with the axis of the cylindrical housing extending horizontally. The exhaust fan housing 40 contains an exhaust fan 41 the motor shaft 42 of which is rotatable about a horizontal axis. The exhaust fan 41 is supported at one end 43 of the fan housing 40 by brackets 44. The other end of the fan housing is closed by an end plate 46 to form an exhaust chamber 47 between the fan blades 48 and the end plate 46. The end plate 46 has a centrally positioned aperture 49 that receives the end 51 of a conduit 52. The other end 53 of the conduit 52 is adapted to be hooked up to the exhaust duct 26, as described with reference to FIGS. 1 and 2. The exhaust duct 26 provides the conduit through which noxious odors may be drawn from the toilet 16 into the fan housing 40 chamber 47 prior to discharge to the atmosphere.

Noxious vapors from the room in which the toilet is located are drawn into the fan housing chamber 47 through an inlet pipe 54 located in the sidewall of the chamber 47. The inlet pipe 54 is connected by a pipe section 55 to a bell mouth opening 56 in the ceiling 13. The ceiling opening may be closed by an ornamental grill 57.

The end 43 of the fan housing 40 is connected by suitable piping to a conventional vent pipe 58 that exhausts to the atmosphere.

Figure 7:
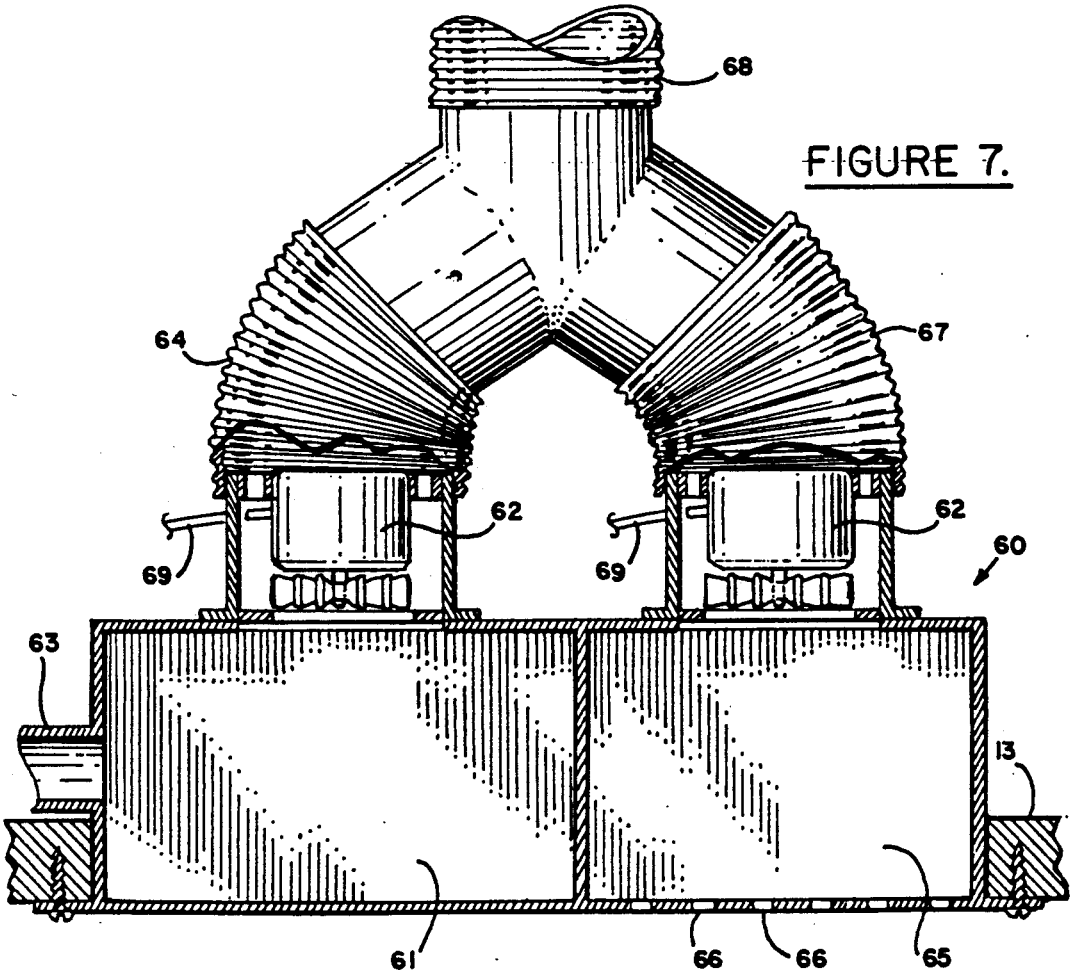
FIG. 7 is a cross sectional view illustrating a further embodiment of the present invention.

Referring now to FIG. 7, an alternate embodiment of the invention is shown in which the exhaust system, generally designated 60 comprises a dual compartment unit having associated with one compartment 61 an exhaust fan 62 drawing suction on an air intake opening 63. The air intake opening 63 is connected by a duct (not shown but similar to duct 26 of FIG. 1) to the exhaust outlet 21 on the toilet seat 16. The noxious vapors drawn into compartment 61 are exhausted to the atmosphere through duct 64. Associated with the second compartment 65, a second exhaust fan 62 draws noxious vapors directly from the room through a screened opening 66 in the ceiling which are exhausted to the atmosphere through a duct 67. The ducts 64 and 67 may be joined into a single duct 68 leading to an atmospheric vent. The dual compartment unit 60 may be required in rooms having a plurality of toilets and a plurality of ceiling exhaust outlets.

The several fan motors 41 and 62 are connected by electrical cables 69 to plugs 71 that can be plugged into convenient electrical outlets.

While the invention has been described with respect to preferred embodiments thereof, it will be readily apparent to those skilled in the art that certain modifications may be made within the spirit and scope of the invention. Accordingly, the invention should not be considered limited by the description of the preferred embodiments but should rather only be limited by the following claims.

I claim:

1. A kit for enhancing the withdrawal of noxious vapors from a bathroom having an existing exhaust fan contained in a housing vented to the atmosphere, the housing having a large air intake opening in the bathroom, the kit including:

(a) a generally annular toilet seat having a central opening and a peripheral conduit that extends internally around the seat and terminates at the rear end of the seat in an exhaust outlet;

and a plurality of laterally extending apertures that communicate the peripheral conduit with the central opening of the toilet seat;

(b) a cover assembly including means for reducing the area of the existing housing air intake opening to a restricted vapor intake aperture;

(c) an exhaust duct for connection at one of its ends to the toilet seat conduit exhaust outlet, the exhaust duct being of sufficient length to extend from its connection to the toilet seat conduit exhaust outlet to the restricted vapor intake aperture in the cover assembly; and (d) said cover assembly further including:

(i) a cover plate having a restricted vapor intake aperture therein, the cover plate being adapted to be mounted over the air intake of the existing fan housing, and (ii) a cover box that covers the cover plate and the end of the exhaust duct attached to the cover plate at the restricted vapor intake aperture;

whereby the exhaust fan can be operated to draw noxious vapors from the toilet seat through the exhaust duct and the restricted vapor intake aperture into the fan housing for discharge to the atmosphere.

2. The kit according to claim 1, in which:

the cover box has a plurality of small apertures communicating with the bathroom; and the cover plate has a plurality of small apertures communicating with the air intake opening of the existing exhaust fan housing whereby noxious vapors from the bathroom space may be exhausted along with the noxious vapors from the vicinity of the toilet seat.

* * * * *